United States Patent [19]

van Gorkum

[11] Patent Number: 4,567,399

[45] Date of Patent: Jan. 28, 1986

[54] CATHODE RAY TUBE WITH SPHERICAL ABERRATION CORRECTION MEANS

[75] Inventor: Aart A. van Gorkum, Eindhoven, Netherlands

[73] Assignee: U.S. Philips Corporation, New York, N.Y.

[21] Appl. No.: 458,231

[22] Filed: Jan. 17, 1983

[30] Foreign Application Priority Data

Feb. 22, 1982 [NL] Netherlands ..... 8200691

[51] Int. Cl.[4] ..... H01J 29/56

[52] U.S. Cl. ..... 313/449; 313/414; 313/458; 313/293

[58] Field of Search ..... 313/449, 458, 414, 293, 313/294

[56] References Cited

U.S. PATENT DOCUMENTS 2,223,040 11/1940 Mahl ..... 313/449

3,376,447 4/1968 Petit ..... 313/449 X

*Primary Examiner*—David K. Moore

*Assistant Examiner*—K. Wieder

*Attorney, Agent, or Firm*—Robert J. Kraus

[57] ABSTRACT

A curved, electrically-conductive foil or gauze member is provided in a second cylindrical accelerating electrode of an electron gun for a cathode ray tube. The curvature of the foil or gauze member initially decreases with distance from the longitudinal axis of the electrode, thereby modifying the shape of the field produced by the electrode and minimizing spherical aberration. The curvature preferably varies according to a zero order Bessel function. Spherical aberration can be made negative by adjusting the relative positions of the member and nearby ends of the second and an adjacent first cylindrical accelerating electrode.

9 Claims, 22 Drawing Figures

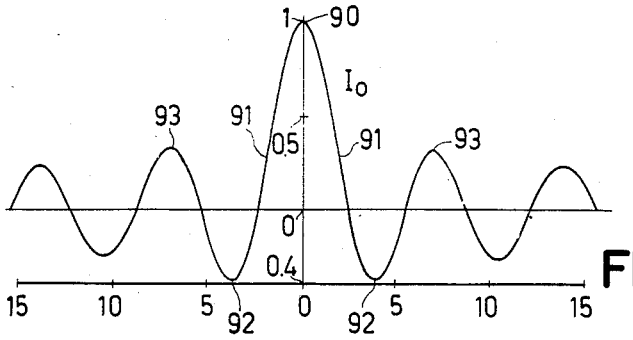
FIG.9a
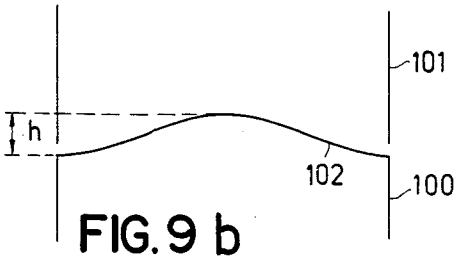
FIG. 9 b
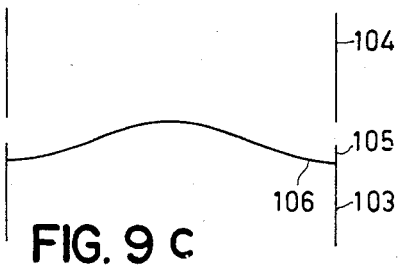
FIG. 9 c
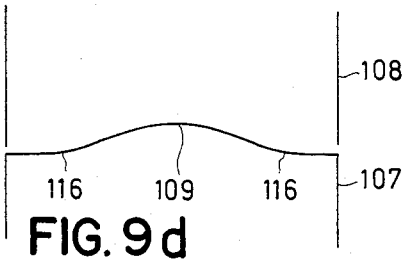
FIG. 9d
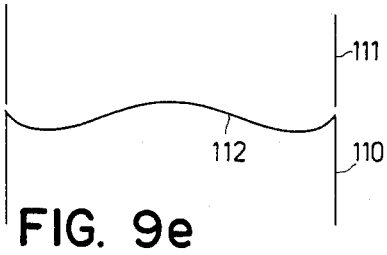
FIG. 9e
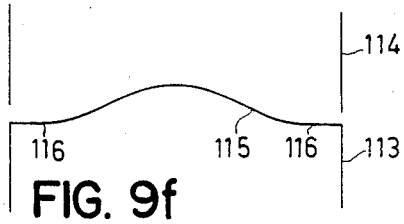
FIG. 9f
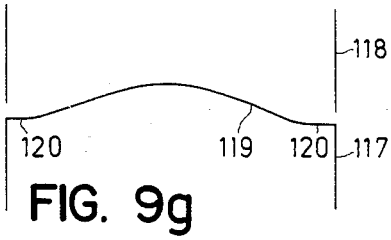
FIG. 9g
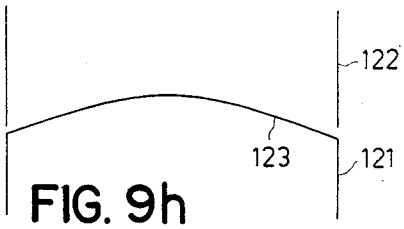
FIG. 9h
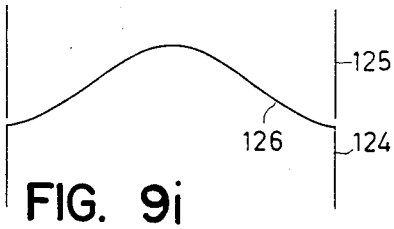
FIG. 9i
FIG. 9

CATHODE RAY TUBE WITH SPHERICAL ABERRATION CORRECTION MEANS

BACKGROUND OF THE INVENTION

The invention relates to a cathode ray tube comprising in an evacuated envelope an electron gun for generating an electron beam which is focused onto a target by means of at least one accelerating electron lens which, viewed in the direction of propagation of the electron beam, comprises a first and a second electrode placed coaxially around the electron beam.

Such cathode ray tubes are used, for example, as a black-and-white or colour display tube for television, as a television camera tube, as a projection television display tube, as an oscilloscope tube or as a tube for displaying digits or characters. This latter type of tube is sometimes termed a DGD tube (data graphic display tube).

Such a cathode ray tube is known, for example, from Netherlands Patent Application No. 7812540 laid open to public inspection and corresponding to U.S. Pat. No. 4,310,776. The electron gun system of a colour display tube described in this Application comprises three electron guns situated with their axes in one plane. The second electrode of the accelerating electron lens of each gun present on the side of the display screen is connected to a common centring sleeve. It is also possible that in addition the first electrodes of the accelerating electron lens form a common component. This is the case, for example, in a so-called integrated electron gun which is also described in the Netherlands Patent Application No. 7812540.

The dimensions of the spot are very important in such tubes. In fact they determine the definition of the displayed or recorded television picture. There are three contributions to the spot dimensions, namely: the contribution as a result of the differences in thermal emanating rates and angles of the electrons emanating from the emissive surface of the cathode, the contributions of the space charge of the beam and the spherical aberration of the electron lenses used. This latter contribution is caused in that electron lenses do not ideally focus the electron beam. In general, electrons which form part of the electron beam and which enter an electron lens farther away from the optical axis of the lens are deflected more strongly by the lens than electrons which enter the lens nearer along the axis. This is termed positive spherical aberration. The spot dimensions increase by the third power of the beam parameters, for example, the angular aperture of the diameter of the incident electron beam. Spherical aberration is therefore sometimes termed a third order error. Long ago (W. Glaser, Grundlagen der Elektronenoptik" "Principles of Electron Optics", Springer Verlag, Vienna 1952) it was demonstrated that in the case of rotationally symmetrical electron lenses in which the potential beyond the optical axis is fixed, for example, by means of metal cylinders, a positive spherical aberration always occurs.

SUMMARY OF THE INVENTION

It is an object of the invention to provide a cathode ray tube in which the spherical aberration is drastically reduced or even made negative to compensate for the positive spherical aberration of a preceding or succeeding lens and to so reduce the spot dimensions. According to the invention a cathode ray of the type described in the opening paragraph is characterized in that the second electrode has an electrically conductive foil which is curved in the direction of the first electrode and which intersects the electron beam. The curvature initially decreases with increasing distance from the optical axis of the electron beam.

A foil is to be understood to include herein an electrically conductive gauze. Electron guns are also known in which two accelerating lenses are used for the focusing of the electron beam. In that case the foil may be used in one of the accelerating lenses or in both. The use of foils and gauzes in electron lenses is not new and was described, for example, in Philips Research Reports 18, 465–605 (1963). Among the applications of foils and gauzes were to be considered especially applications in which a very strong lens is desired with a comparatively small potential ratio of the lens. This potential ratio is the ratio between the potentials of the lens electrodes. In an accelerating lens the lens action takes place by a converging lens effect in the low potential part of the lens and a smaller diverging effect in the high potential part of the lens so that the resulting lens behaviour is converging. So the lens is composed of a positive and a negative lens. By providing a flat or spherically curved gauze or foil on the edge of the second electrodes which faces the first electrode, the negative lens is obviated and a purely positive lens is obtained which thus has a much stronger lens effect. However, this lens still shows spherical aberration. A spherical gauze of foil in an accelerating electron lens only gives a small reduction of the spherical aberration, as will be demonstrated hereinafter. By causing according to the invention the radius of curvature of the gauze of foil to initially increase with distance from the optical axis, a variation in strength of the lens takes place. The strength is increased in the centre and is decreased toward the edge. As a result of this a lens is obtained which is of equal strength for all parts of the electron beam. This is not the case in the known gauze lenses which comprise a flat gauze (or foil) or a spherical gauze (or foil) having a constant radius of curvature. By the choice of the variation of the radius of curvature of the gauze or the foil according to the invention the spherical aberration can be drastically reduced or even be made negative. Both from measurements and calculations it follows that a form of the foil or gauze substantially corresponding to the form of the central part of a zero order Bessel function, preferably to the first minimum, is a very favourable choice, which will be explained in detail hereinafter. Up to the first minimum of the zero order Bessel function this form deviates little from the cosine form. In contrast with the use of a foil, however, the use of a gauze gives an extra contribution to the dimension of the spot. This is the result of the apertures in the gauze which operate as negative diaphragm lenses. As described in Philips Research Reports 18, 465–605 (1963) this contribution is proportional to the pitch of the gauze. However, this pitch may be chosen such that this contribution is much smaller than the remaining contributions to the target increase. The remaining contribution of the spherical aberration of the main lens can be made smaller, by a correct choice of the shape of the gauze, than the contribution of the pitch of the gauze. When a cylindrical collar extends from the edge of the foil or gauze of the second electrode in the direction of the first electrode it is even possible to make an accelerating electron lens having a negative spherical aberration. This effect can also be obtained by making the distance (d) between the two electrodes of the accelerating lens larger. This negative spherical aberration may serve to compensate for a positive spherical aberration of another preceding or succeeding lens in the electron gun. The extent to which the spherical aberration is corrected is also determined by the height (h) of the gauze according to the invention. The height is the maximum distance between parts of the gauze measured along the axis of the lens (see also FIG. 9*b*).

Since it is possible in a cathode ray tube according to the invention to reduce the spherical aberration it is no longer necessary to use an electron lens which is much larger than the beam diameter. As a result of this it is possible to make electron guns having lens electrodes with a comparatively small diameter as a result of which the neck of the cathode ray tube in which the electron gun is mounted can have a comparatively small diameter. As a result of this, the deflection coils are situated closer to the electron beams and a smaller deflection energy will suffice. Suitable materials for the manufacture of such foils and gauzes are, for example, nickel, molybdenum and tungsten. A nickel gauze can be very readily deposited electrolytically (electroformed by electrolytic deposition). It is possible to make woven gauzes of molybdenum and tungsten with a transmission of 80%.

The prior art foils or gauzes used for reducing spherical aberration are flat or spherical (see, for example, Optik 46 (1976) No. 4, 463–473 "Der Öffnungsfehler 3. Ordnung und der axiale Farbfehler von rotationssymmetrischen Elektronenlinsen mit gekrümmter geladener transparanter Folie", H. Hoch, E. Kasper, D. Kern). The effect of the spherical aberration of such foils in an accelerating electron lens, however, is not large. This is quite understandable. A flat or a spherical gauze more or less follows the shape of the equipotential planes between two lens electrodes without a gauze. According to the invention the shape of the equipotential planes is influenced to reduce the spherical aberration.

Because the accelerating electron lenses for cathode ray tubes according to the invention have substantially no spherical aberration, the electron guns can be constructed more simply and consist, for example, of a cathode, a control grid and the accelerating electron lens.

In German Patent Specification No. 1,134,769 corresponding to U.S. Pat. No. 3,101,430 a device is described in which a spherical gauze electrode is suspended in an electrically insulated manner between two ring electrodes. This gauze electrode is used to compensate for the spherical aberration of a magnetic focusing lens. The gauze does not form part of the lens to be corrected. Moreover, the magnetic lens is not an accelerating lens.

A cathode ray tube having a gauze curved in the direction of the target as a result of which a negative accelerating lens is formed to obtain deflection amplification without frame distortion is also known from U.S. Pat. No. 3,240,972. However, the spherical aberration of the electron beam is not reduced thereby.

BRIEF DESCRIPTION OF THE DRAWING

The invention will now be described in greater detail, by way of example, with reference to a drawing, in which:

FIG. 8*b* shows an enlargement at the focus of the electron beam focused by means of the lens of FIG. 8*a,* and FIG. 9*a* shows a zero order Bessel function, while FIGS. 9*b* to 9*i* are sectional views of a number of accelerating electron lenses in accordance with the invention.

DESCRIPTION OF THE PREFERRED EMBODIMENT

Figure 1:
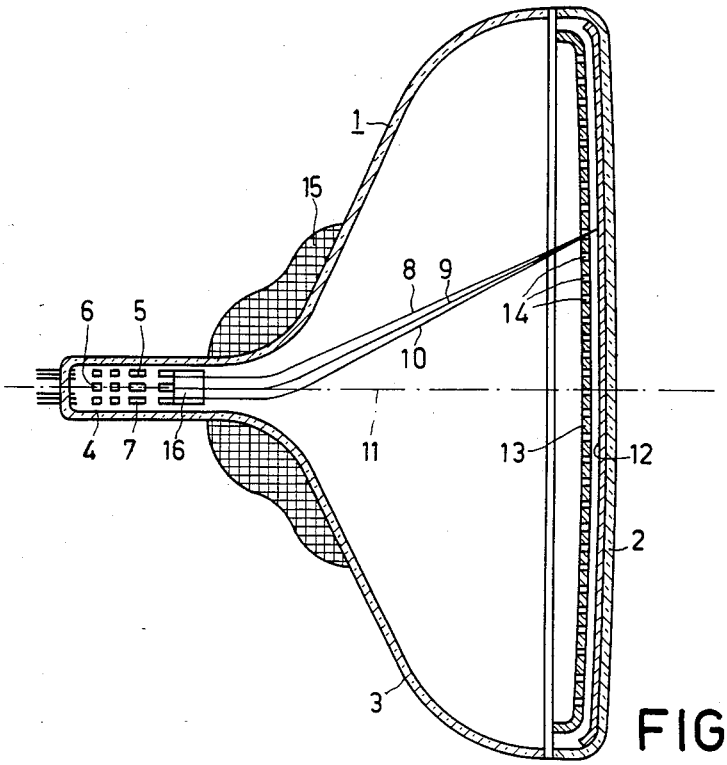
FIG. 1 is a longitudinal sectional view of a cathode ray tube according to the invention.

FIG. 1 shows diagrammatically and by way of example a cathode ray tube according to the invention, in this case a sectional view of a colour display tube of the "in-line" type. In a glass envelope 1 which is composed of a display window 2, a funnel-shaped part 3 and a neck 4, three electron guns 5, 6 and 7 are provided in said neck and generate the electron beams 8, 9 and 10, respectively. The axes of the electron guns are situated in one plane, the plane of the drawing. The axis of the central electron gun 6 coincides substantially with the tube axis 11. The three electron guns open into a sleeve 16 which is situated coaxially in the neck 4. The display window 2 comprises on its inside a large number of triplets of phosphor lines. Each triplet comprises a line consisting of a green-luminescing phosphor, a line of a blue-luminescing phosphor and a line of a red-luminescing phosphor. All triplets together constitute the display screen 12. The phosphor lines are pendicular to the plane of the drawing. In front of the display screen the shadow mask 13 is positioned in which a large number of elongate apertures 14 are provided through which the electron beams 8, 9 and 10 emanate. The electron beams are deflected in a horizontal direction (in the plane of the drawing) and in a vertical direction (perpendicularly thereto) by the system of deflection coils 15. The three electron guns are mounted so that the axes thereof enclose a small angle with each other. As a result of this the electron beams pass through the apertures 14 at an angle, the so-called colour selection angle, and each impinges only on phosphor lines of one colour.

Figure 2:
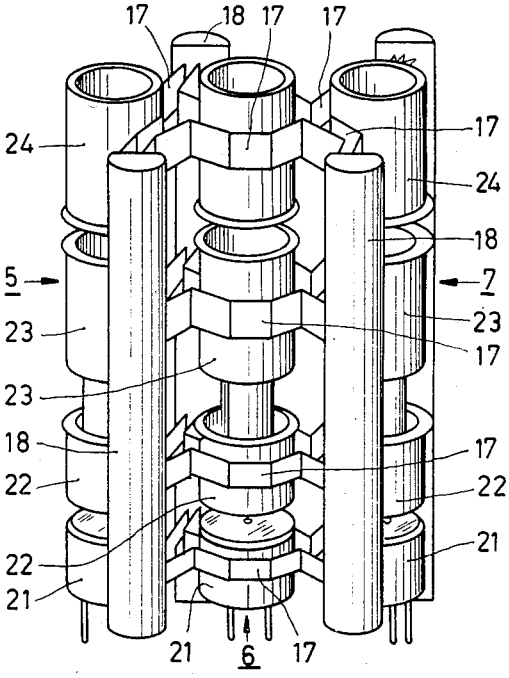
FIG. 2 is a sectional view of an electron gun system for the cathode ray tube shown in FIG. 1.

FIG. 2 is a perspective view of the three electron guns 5, 6 and 7. The electrodes of this triple electron gun system are positioned with respect to each other by means of metal strips 17 which are sealed in glass assembly rods 18. Each gun comprises a cathode (not visible), a control electrode 21, a first anode 22 and electrodes 23 and 24. The electrodes 23 and 24 together form an accelerating electron lens by which the electron beams are focused onto the display screen 12 (FIG. 1). The electrodes 24 include gauzes 30 (not visible in this Figure) curved in the direction of the electrodes 23.

Figure 3:
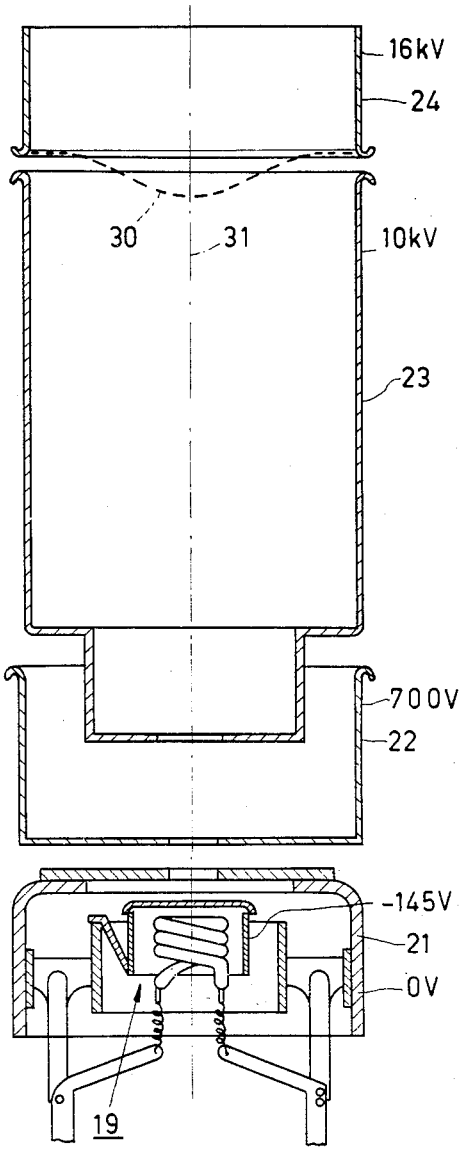
FIG. 3 is a longitudinal sectional view of one of the electron guns of the system shown in FIG. 2.

FIG. 3 is a longitudinal sectional view of one of the electron guns. A cathode 19 is present in the electrode 21. Electrode 24 has a gauze 30 consisting of tungsten (wire diameter 7.5 μm and pitch 75 μm). The curvature of the gauze initially decreases with distance from axis 31. As will be explained with reference to FIGS. 6*a* and 6*b* to 8*a* and 8*b*, this results in a reduction of the positive spherical aberration or, dependent on the distance (see FIG. 8*a*), even in a negative spherical aberration. The potentials supplied to the electrodes are shown in the Figures.

Figure 4A:
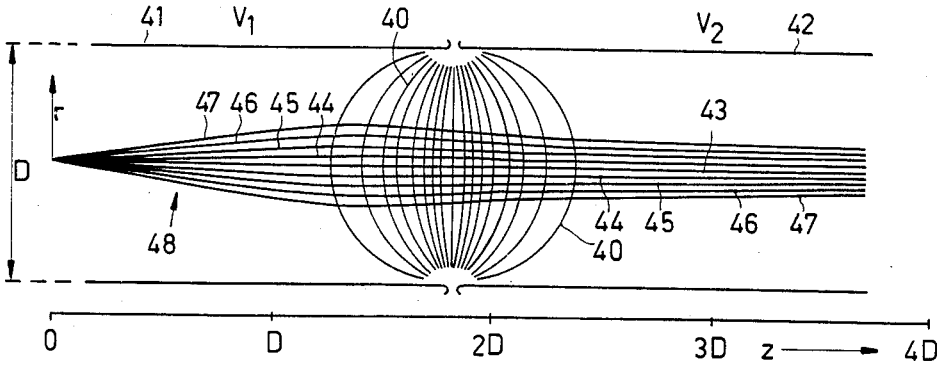
FIG. 4a PRIOR ART
FIG. 4*a* is a longitudinal sectional view of a prior art accelerating electron lens.
Figure 4B:
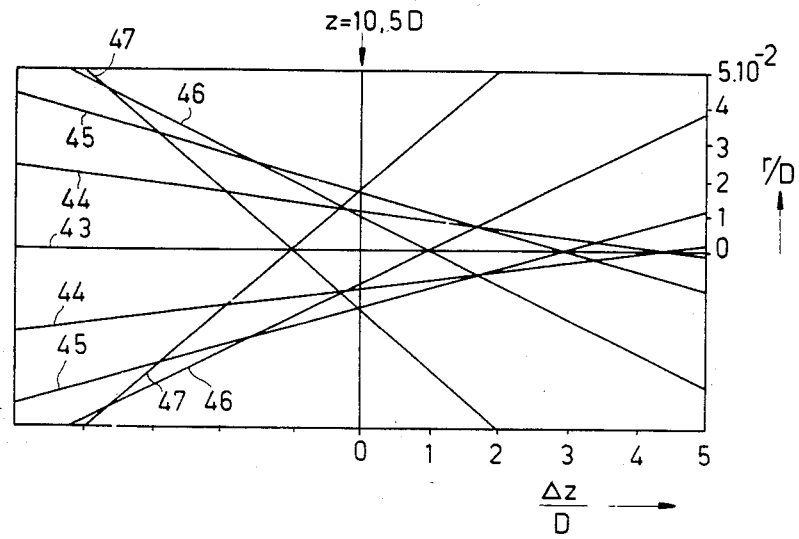
FIG. 4b PRIOR ART
FIG. 4*b* shows an enlargement at the focus of the electron lens focused by means of the lens of FIG. 4*a;*
Figure 5A:
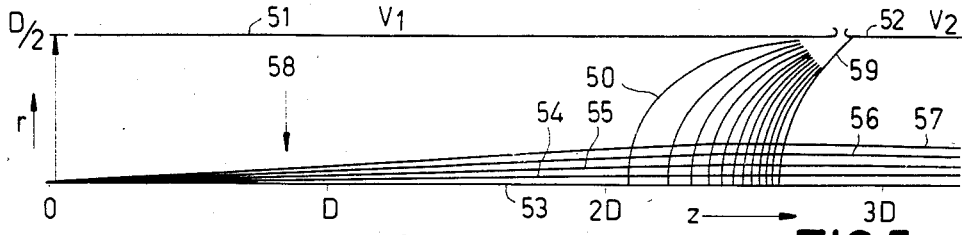
FIG.5a PRIOR ART
FIG. 5*a* is a longitudinal sectional view of a prior art accelerating electron lens having a spherical gauze.

FIG. 4*a* is a diagrammatic sectional view of a prior art accelerating electron lens. The lens comprises a first cylindrical electrode 41 having a potential $V_1$ and a second cylindrical electrode 42 having a potential $V_2$. By making $V_2/V_1=10$, the focal distance on the picture side is approximately 2.5 D, where D is the diameter of the cylindrical electrodes. The equipotential lines 40 (these are the lines of intersection of the equipotential planes with the plane of the drawing) are shown every 0.5 $V_1$. The object distance in this embodiment and in the following embodiments has been chosen such that the paraxial linear magnification is always 5. The total angular aperture of the electron beam 48 is 0.15 rad. Beside the central path 43 four electron paths 44, 45, 46 and 47 are shown distributed equidistantly over the angular aperture on either side of the central path. FIG. 4*b* shows an enlargement at the focus (point of minimum cross-section) of the electron beam shown in FIG. 4*a* at the axial location Z=10.5 D. The minimum beam diameter divided by D is $3.3\times10^{-2}$. The rays 44 intersect the central path 43 in quite a different place and farther away from the object than the rays 45, 46 and 47 situated farther away from the central path 43. This is termed positive spherical aberration. FIG. 5*a* shows diagrammatically an accelerating electron lens having a spherical gauze 59 having a radius of curvature of 0.625 D. The lens consists of a first cylindrical electrode 51 having a potential $V_1$ and a second cylindrical electrode 52 having a potential $V_2$. By making $V_2/V_1=1.6$ (for example, $V_1=10$ kV and $V_2=16$ kV) the focal distance on the picture side is again approximately 2.5 D. The equipotential lines 50 are shown every 0.05 $V_1$. The overall angular aperture of the electron beam 58 is 0.06 rad. As compared with the angular aperture of FIG. 4*a* this has been chosen to be smaller in connection with the other voltage ratio $V_2/V_1$. Beside the central path 53, four electron paths 54, 55, 56 and 57 are shown as distributed equidistantly over the angular aperture on one side of the central path. The electron paths situated symmetrically on the other side of the central path are not shown due to said symmetry.

Figure 5B:
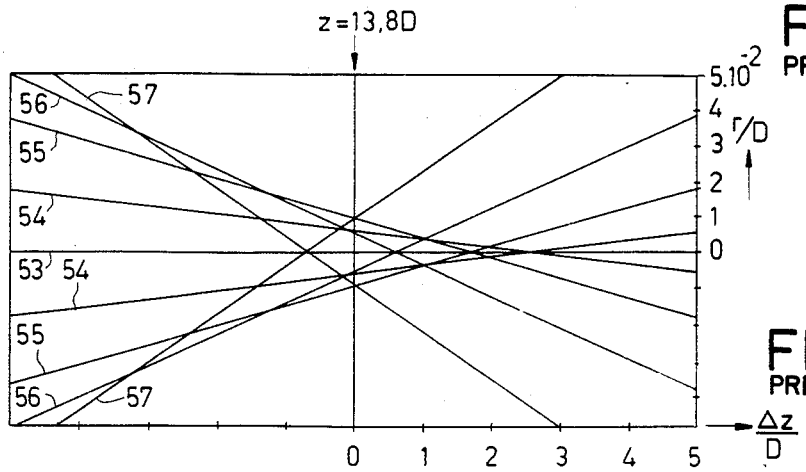
FIG.5b PRIOR ART
FIG. 5*b* shows an enlargement at the focus of the electron beam focused by means of the lens of FIG. 5*a;*

FIG. 5*b* shows an enlargement of the focus at the location Z=13.8 D. The minimum electron beam diameter divided by $D=1.8\times10^{-2}$.

From this Figure it follows that the spherical aberration is reduced by using a spherical gauze in an accelerating electron lens. As a matter of fact, the point of intersection of the inner rays (54) with the central path lies closer to the point of intersection of the outer rays (57) with the central path than in FIG. 4*b*.

Figure 6A:
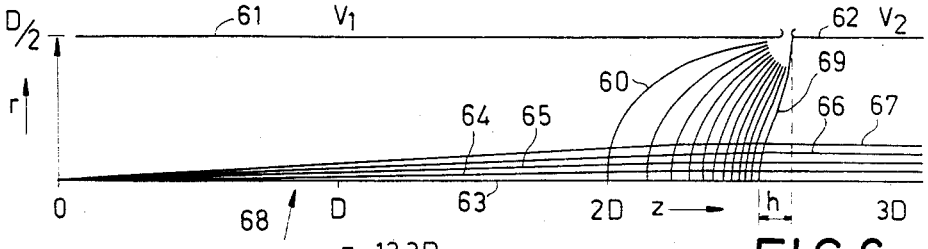
FIG. 6*a* is a longitudinal sectional view of an accelerating electron lens according to the invention.

FIG. 6*a* shows diagrammatically an accelerating electron lens having a gauze 69 which according to the invention has the shape of the central part of a zero order Bessel function in which the first minimum of the zero order Bessel function coincides with the edge of the circular electrode 62. The height h of the gauze is 0.125 D. The lens further consists of a first cylindrical electrode 61 having a potential V1. The second cylindrical electrode 62 has a potential V2. By making $V_2/V_1=1.6$ (for example $V_1=10$ kV and $V_2=16$ kV) the focal distance on the picture side is again approximately 2.5 D. The equipotential lines 60 are shown every 0.05 V1. The overall angular aperture of the electron beam is 0.06 rad. Four electron paths 64, 65, 66, 67 on one side of the central path 63 are again shown.

Figure 6B:
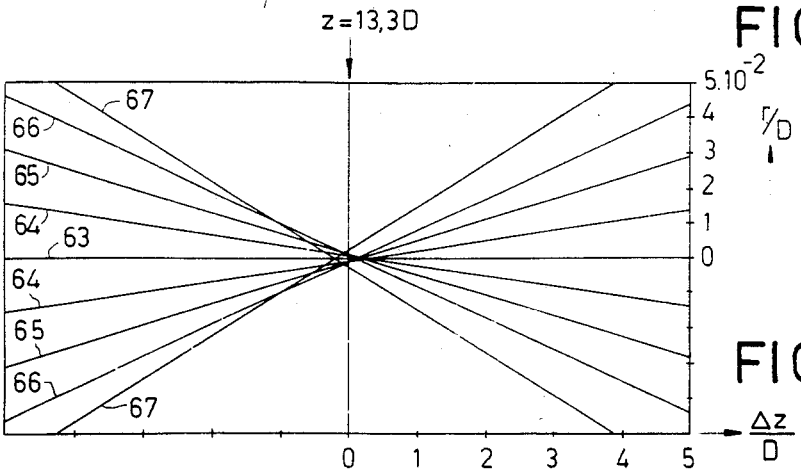
FIG. 6*b* is an enlargement at the focus of the electron beam focused by means of the lens of FIG. 6*a;*

FIG. 6*b* shows an enlargement of the focus at Z=13.3 D. From this Figure it follows that by using a gauze having a shape which corresponds substantially to the shape of the central part of a zero order Bessel function the spherical aberration can substantially be eliminated. The minimum beam cross-section is approximately 25% of the minimum beam cross-section according to FIG. 5*b*.

Figure 7A:
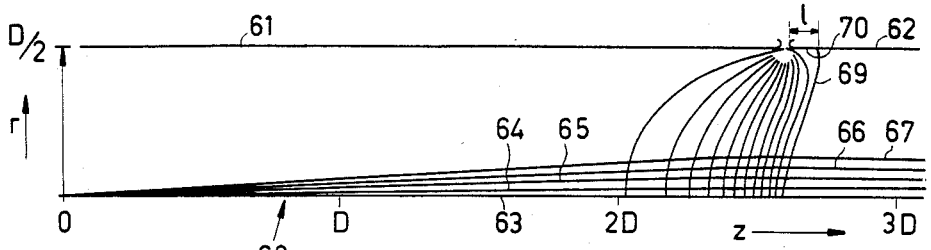
FIG. 7*a* is a longitudinal sectional view of another embodiment of an accelerating electron lens according to the invention.
Figure 7B:
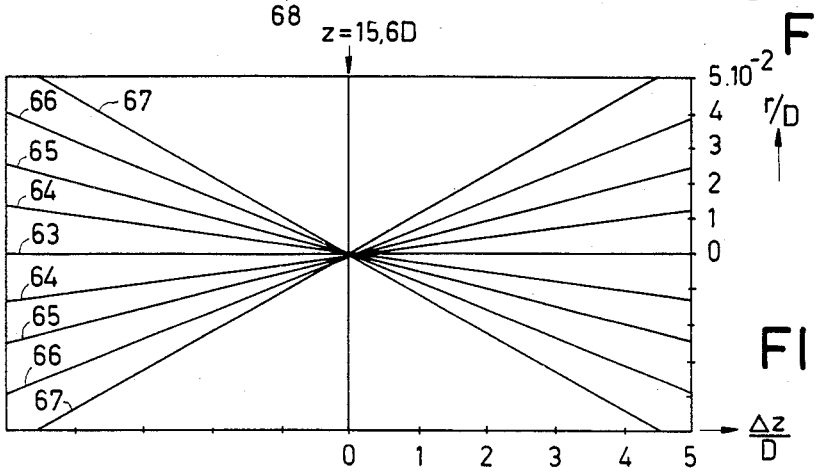
FIG. 7*b* shows an enlargement at the focus of the electron beam focused by means of the lens of FIG. 7*a;*

FIGS. 7*a* and 7*b* show an accelerating electron lens and a magnification of the focus analogous to FIGS. 6*a* and 6*b*. In this case, however, electrode 62 has a collar 70 projecting in the direction of electrode 61 and having a height l of 0.125 D. As follows from FIG. 7*b*, the minimum beam cross-section at the location Z=15.6 D is very small and there is hardly any spherical aberration.

Figure 8A:
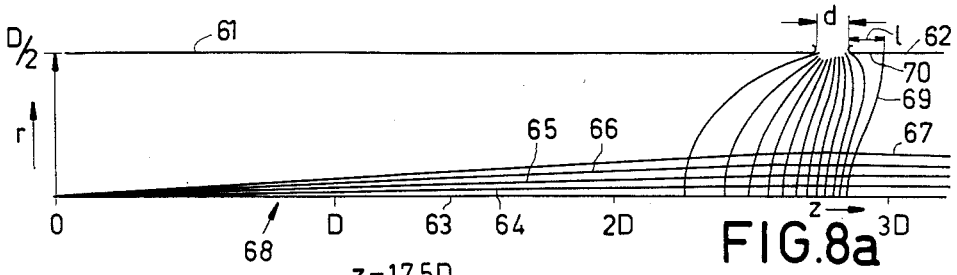
FIG. 8*a* is a longitudinal sectional view of still another embodiment of an accelerating electron lens having a negative spherical aberration.
Figure 8B:
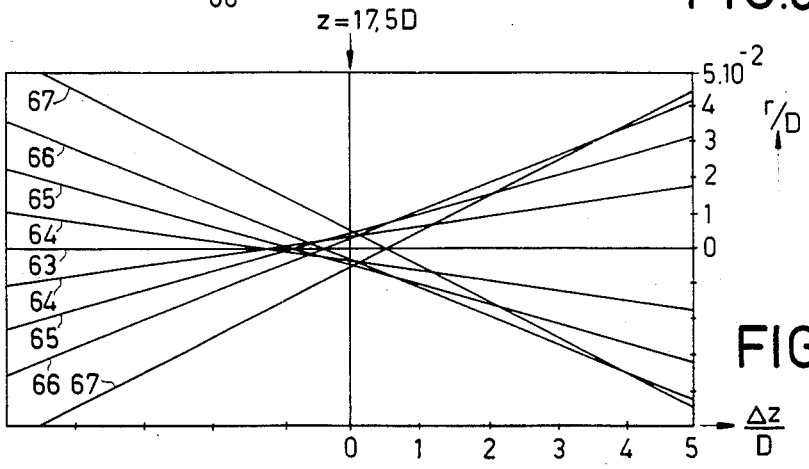

FIG. 8*a* shows an accelerating electron lens identical to that of FIG. 7*a* in which the distance d between the electrodes 61 and 62 is enlarged and is 0.125 D. From FIG. 8*b* it follows that such a lens has a negative spherical aberration. The inner rays 64 of the electron beam intersect the central path sooner than the more outwardly situated rays. It is possible with such a lens having negative spherical aberration to compensate for the positive spherical aberration of a preceding lens. For example, the electrodes 22 and 23 in FIG. 1 together constitute an accelerating electron lens having a positive spherical aberration. This can be compensated by a negative spherical aberration of the lens formed by the electrodes 23 and 24, so that the overall contribution of the spherical aberration to the spot dimension becomes minimum. FIG. 9*a* shows the variation of the zero order Bessel function. In the centre is present the first and largest maximum 90 with beside it the bending points 91 and the first minimum 92. Beside that are the second maxima 93 succeeded by alternating minima and maxima. For the invention only the variation of said function up to the second maxima 93 is of importance.

FIG. 9*b* shows diagrammatically an accelerating electron lens having two cylindrical electrodes 100 and 101. Electrode 100 is provided with a curved gauze 102 which is curved according to a zero order Bessel function. The edge forms the first minimum of the zero order Bessel function. The height h of the gauze is also decisive of the extent to which the spherical aberration is compensated. In FIG. 6*a* the height h is, for example, 0.125 D. FIG. 9*c* shows diagrammatically an accelerating electron lens having two cylindrical electrodes 103 and 104. Electrode 103 has a cylindrical collar 105 extending in the direction of electrode 104. The shape of the gauze 106 is identical to the shape of the gauze 102 of FIG. 9*b*. Moreover the distance between the electrodes 103 and 104 is larger than the distance between the electrodes 100 and 101 (FIG. 9*b*) as a result of which, as is shown in FIGS. 8*a* and *b*, a negative spherical aberration is obtained.

FIG. 9*d* shows diagrammatically an accelerating electron lens having two cylindrical electrodes 107 and 108. Electrode 107 is provided with a gauze 109 which is curved according to the central part of a zero order Bessel function. From the third bend a flat part 116 extends towards the edge of electrode 107.

FIG. 9*e* shows diagrammatically an accelerating lens having two cylindrical electrodes 110 and 111. Electrode 110 has a gauze 112 which is curved according to a zero order Bessel function up to the second zero passage. FIG. 9*f* shows diagrammatically an accelerating electron lens having two cylindrical electrodes 113 and 114. The shape of the curved gauze 115 is identical to that of the gauze shown in FIG. 9*d* but the height is $1\frac{1}{2}\times$ the height of the curved gauze 109 (FIG. 9*d*).

FIG. 9*g* shows digrammatically an accelerating electron lens having two cylindrical electrodes 117 and 118. The shape of the curved gauze 119 is identical to that of the gauze shown in FIG. 9*f*, but the flat edge 120 is smaller than the flat edge 116 in FIG. 9*f*.

FIG. 9*h* shows diagrammatically an accelerating electron lens having two cylindrical electrodes 121 and 122. Electrode 121 has a gauze 123 which is curved according to a zero order Bessel function up to the first bend.

FIG. 9*i* shows diagrammatically an accelerating electron lens having two cylindrical electrodes 124 and 125. The shape of the curved gauze 126 is similar to that of the gauze shown in FIG. 9*b* but the height h is $2\times$ the height of the curved gauze 102 of FIG. 9*b*.

All the gauze shapes shown have in common that they are at least partly curved according to a zero order Bessel function. The shapes can be chosen in accordance with the electron beam diameter and the electrode diameter. The height h of the gauze and the distance d between the two electrodes of the accelerating electron lens can be determined with reference to experiments and calculations.

Because the shape of a zero order Bessel function up to the first minimum differs little from the shape of the cosine function, it will be obvious that gauzes or foils having the shape of a cosine function or another shape deviating little from a zero order Bessel function may also be used. The gist of the invention in fact is that the radius of curvature of the gauze initially increases with an increasing distance from the optical axis of the electron lens so that a strength variation of the lens takes place, said strength being increased in the centre of the beam and being decreased towards the edge. As a result of this a lens is obtained which has substantially the same strength for all parts of the electron beam.

What is claimed is:

1. In a cathode ray tube comprising an evacuated envelope containing a target and an electron gun for producing an electron beam directed along a longitudinal axis of the gun and for focusing said electron beam onto said target, said electron gun including, in the direction of propagation of the electron beam, first and second adjacent electrodes disposed coaxially around said axis for producing an accelerating electron lens, the improvement comprising means for effecting a predefined correction of spherical aberration of said lens, said means including a conductive, electron penetrable member extending across and electrically-connected to an end of the second electrode which is nearby the first electrode, said member being curved toward said first electrode, the curvature of said member initially decreasing with distance from said axis.

2. A cathode ray tube as in claim 1 where the shape of said member conforms approximately to the shape of a central portion of a zero order Bessel function.

3. A cathode ray tube as in claim 2 where said central portion includes a first minimum on each side of the center of said Bessel function.

4. A cathode ray tube as in claim 1, 2 or 3 including a cylindrical collar extending from said member's periphery toward said first electrode.

5. A cathode ray tube as in claim 4 where the periphery of said member is attached to the second electrode at a predetermined distance from said end, the portion of said second electrode extending between said periphery and said end forming said cylindrical collar.

6. A cathode ray tube as in claim 1, 2 or 3 where said member comprises a foil.

7. A cathode ray tube as in claim 1, 2 or 3 where said member comprises a gauze.

8. A cathode ray tube as in claim 1, 2 or 3 where said electron gun comprises, in succession, a cathode, a control grid and said first and second electrodes.

9. A cathode ray tube as in claim 1, 2 or 3 where said cathode ray tube comprises a datagraphic display tube.

* * * * *